US009109838B2

(12) United States Patent
Imai

(10) Patent No.: US 9,109,838 B2
(45) Date of Patent: Aug. 18, 2015

(54) GAS BLOWING NOZZLE

(75) Inventor: Shinobu Imai, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 0 days.

(21) Appl. No.: 13/808,292

(22) PCT Filed: Jun. 23, 2011

(86) PCT No.: PCT/JP2011/064477

§ 371 (c)(1),
(2), (4) Date: Jan. 4, 2013

(87) PCT Pub. No.: WO2012/005119

PCT Pub. Date: Jan. 12, 2012

(65) Prior Publication Data

US 2013/0106035 A1 May 2, 2013

(30) Foreign Application Priority Data

Jul. 6, 2010 (JP) ..... 2010-153958

(51) Int. Cl.
*C21C 7/072* (2006.01)
*F27D 99/00* (2010.01)
(Continued)

(52) U.S. Cl.
CPC ..... *F27D 99/00* (2013.01); *B22D 1/002* (2013.01); *C21C 5/34* (2013.01); *C21C 5/48* (2013.01);
(Continued)

(58) Field of Classification Search
CPC ..... C22B 9/05; C22B 21/064; B22D 1/002; C21C 5/48; C21C 7/072; C21C 5/34; C21C 5/35; F27D 99/00; F27D 3/18; F27D 3/20; F27D 3/205; F27D 3/22; F27D 3/225
USPC ..... 266/265, 270, 216–220, 47, 236, 268; 75/401, 405, 555
See application file for complete search history.

(56) References Cited

U.S. PATENT DOCUMENTS 3,854,932 A * 12/1974 Bishop, Jr. ..... 75/512
4,089,677 A * 5/1978 Spenceley et al. ..... 75/532
(Continued)

FOREIGN PATENT DOCUMENTS

JP 56-58918 U 5/1981
JP 63-100117 A 5/1988
(Continued)

OTHER PUBLICATIONS

International Search Report (PCT/ISA/210) dated Oct. 4, 2011, issued by the International Searching Authority in International Application No. PCT/JP2011/064477.
(Continued)

*Primary Examiner* — Scott Kastler
*Assistant Examiner* — Michael Aboagye
(74) *Attorney, Agent, or Firm* — Sughrue Mion, PLLC

(57) ABSTRACT

This invention relates to a gas blowing nozzle for blowing a gas to a molten metal in a furnace, the gas blowing nozzle including: a first nozzle section including a plurality of first narrow metal pipes having open furnace-side tips exposed to an inside of the furnace and being in the state of capable of blowing a gas to the molten metal in the furnace, a first surge tank communicated with the first narrow metal pipes, and a first refractory protecting the first narrow metal pipes and the first surge tank; and a second nozzle section including a plurality of second narrow metal pipes, a second surge tank communicated with the second narrow metal pipes, and a second refractory protecting the second narrow metal pipes and the second surge tank.

3 Claims, 9 Drawing Sheets

(51) Int. Cl.

| | |
|---|---|
| ***B22D 1/00*** | (2006.01) |
| ***C21C 5/34*** | (2006.01) |
| ***C21C 5/48*** | (2006.01) |
| ***F27B 3/20*** | (2006.01) |
| ***F27B 3/22*** | (2006.01) |
| ***F27D 1/12*** | (2006.01) |

(52) U.S. Cl.
CPC . *C21C 7/072* (2013.01); *F27B 3/20* (2013.01); *F27B 3/205* (2013.01); *F27B 3/22* (2013.01); *F27B 3/225* (2013.01); *F27D 1/12* (2013.01)

(56) References Cited

U.S. PATENT DOCUMENTS

| | | | | | |
|---|---|---|---|---|---|
| 4,198,230 | A | * | 4/1980 | Brotzmann et al. | 75/530 |
| 4,334,921 | A | * | 6/1982 | Hirai et al. | 75/544 |
| 4,438,907 | A | * | 3/1984 | Kimura et al. | 266/217 |

FOREIGN PATENT DOCUMENTS

| | | | | | |
|---|---|---|---|---|---|
| JP | 2-61950 | U | | 5/1990 | |
| JP | 4-120211 | A | | 4/1992 | |
| JP | 05-098332 | | * | 4/1993 | C21C 5/48 |
| JP | 5-98337 | A | | 4/1993 | |
| JP | 10-265829 | A | | 10/1998 | |
| JP | 2000-212634 | A | | 8/2000 | |
| JP | 2003-231912 | A | | 8/2003 | |

OTHER PUBLICATIONS

Written Opinion (PCT/ISA/237) dated Oct. 4, 2011, issued by the International Searching Authority, in International Application No. PCT/JP2011/064477.

* cited by examiner

GAS BLOWING NOZZLE

TECHNICAL FIELD

The present invention relates to a gas blowing nozzle attached to an electric furnace, a converter or the like and used to blow a gas to a molten metal.

BACKGROUND OF THE INVENTION

A gas blowing nozzle for blowing an inert gas such as a nitrogen gas or an argon gas, a carbon monoxide gas or a carbon dioxide gas into a molten metal in a refining furnace is generally arranged in a bottom or a side wall of a molten metal refining vessel such as an electric furnace or a converter.

Since the gas blowing nozzle is required to have thermal spalling resistance, abrasion resistance, and corrosion resistance to hot metal, molten steel, slug and the like, the gas blowing nozzle is generally prepared by installing one or a plurality of narrow metal pipes (for example, stainless steel) for blowing a gas in a carbon-containing refractory such as MgO—C brick in the form that the pipes are embedded so as to penetrate through the refractory.

A single pipe type nozzle having a large diameter is used as a gas blowing nozzle used to blow a large amount of a gas, and a narrow pipe type nozzle having a plurality of narrow metal pipes embedded so as to penetrate through a refractory is used in the applications that are not particularly necessary to blow a large amount of a gas and are desirable to blow a gas of minute bubbles.

Furthermore, the gas blow nozzle is that during the use, the temperature of the nozzle itself is increased, and by carburization phenomenon that carbon in a carbon-containing refractory permeates in narrow metal pipes, a melting point of the narrow metal pipes is decreased and the narrow metal pipes melt.

When the narrow metal pipes melt, a molten steel flow caused by the blowing of a gas directly collides against a carbon-containing refractory, and the refractory tends to wear down. For this reason, a life of the gas blowing nozzle itself becomes short.

Therefore, to solve such problems, technologies as in the following Patent Documents 1 to 6 are proposed.

Patent Document 1 proposes a gas blowing nozzle in which narrow metal pipes for gas blowing are coated with a refractory such as a carbon-free castable, and then embedded in a carbon-containing refractory.

However, in the case of the gas blowing nozzle of Patent Document 1, a refractory having poor thermal spalling resistance and corrosion resistance such as a carbon-free castable wears down first, and a castable portion becomes a rate-determining factor of a life. Therefore, there is the problem that service life cannot further be prolonged in the state that a nozzle is maintained in a give length.

Patent Document 2 proposes a plug for blowing an alumina-carbonaceous gas in which a slurry liquid comprising MgO type ultrafine powder as a main component is applied to the outer periphery of a plurality of gas blowing narrow metal pipes provided in an alumina-carbonaceous refractory to form an MgO coating layer.

However, in the case of the gas blowing plug of Patent Document 2, in installing MgO-coated narrow metal pipes in the carbon-containing refractory, the coating layer peels, resulting in carburization in the peeled portion, and sufficient effect is not obtained. Therefore, there is the problem that the service life cannot further be prolonged in the state that a nozzle is maintained in a give length.

Patent Document 3 proposes a gas blowing nozzle in which a fire-resistant sintered body is provided between a carbon-containing refractory and gas blowing narrow metal pipes, thereby preventing carburization.

However, in the case of the gas blowing nozzle of Patent Document 3, it is generally necessary to interpose a mortar between the gas blowing narrow metal pipes and the fire-resistant sintered body, and there is the problem that the mortar having poor abrasion resistance and corrosion resistance wears out first, and damage expands from the mortar portion. Furthermore, even in the case of Patent Document 3, there is the problem that the service life cannot further be prolonged in the state that a nozzle is maintained in a give length.

Patent Document 4 proposes a gas blowing nozzle in which alumina or magnesia is sprayed to gas introducing narrow metal pipes, thereby preventing carburization.

However, in the case of the gas blowing nozzle of Patent Document 4, because a thermal expansion coefficient differs between the gas introducing narrow metal pipes and a spraying material, there is the problem that the spraying material peels due to expansion difference, and the narrow metal pipes are carburized in the peeled portion. Therefore, even in the case of the constitution of Patent Document 4, there is the problem that the service life cannot further be prolonged in the state that a nozzle is maintained in a give length.

Patent Documents 1 to 4 above each intend to improve durability by suppressing carburization, and the service life can be prolonged for only the period that the carburization is suppressed. However, if the service life is intended to further prolong, it is necessary to further lengthen the nozzle.

However, if the nozzle is lengthened until the target service life is obtained, a distance from a gas discharge hole to a surface of a molten steel becomes short, and this gives rise to the problem that refining efficiency is decreased by the deterioration of stirring efficiency.

Furthermore, in the case that the nozzle is excessively projected from a surface of a hearth in a refining furnace, a surface to be heated is increased, and thermal spalling or structural spalling tends to cause.

Furthermore, where the entire hearth in the refining furnace is raised for only the lengthened portion of the nozzle, this gives rise to the problem that not only refractory costs are increased, but a given amount of a molten steel cannot be refined.

Therefore, the actual situation is that it is difficult in the constitutions of Patent Documents 1 to 4 to further prolong the service life by lengthening the nozzle.

By the way, Patent Documents 1 to 4 relate to the technology of intending to increase the number of operation of a refining vessel by improving durability of the nozzle itself becoming a rate-determining factor of a life, and further propose the technology of increasing the number of operation of the refining vessel by a repairing or switching method of a gas blowing nozzle.

For example, Patent Document 5 discloses a bottom blowing converter in which gas blowing nozzles installed on many places are previously embedded in a furnace bottom refractory and distances from the surface of the furnace bottom refractory to the tips of the nozzles are varied respectively.

However, in Patent Document 5, a gas blowing nozzle during standby does not aerate a gas. Therefore, control of residual thickness is difficult, and it is difficult to switch gas blowing with good timing. If messing up the timing, a molten steel penetrates inside of the nozzle, and there is a risk of causing steel leakage. The gas blowing nozzle of Patent Document 5 is not a fine pipe type, but a single type using a pipe having large diameter. Therefore, there is the problem that a risk of steel leakage is further high.

Moreover, there is the problem that construction is complicated and troublesome such that a blind cap brick or a blind cap receiving brick is provided in the furnace-side tips of the nozzle.

Furthermore, there is the problem that opening work of a switching tuyere and occluding work of the used tuyere are troublesome when switching gas blowing.

Patent Document 6 proposes a molten metal refining vessel in which a gas blowing nozzle having gas introduction pipes opened from the time of beginning of use of the molten metal refining vessel, and a gas blowing nozzle in which its tip surface is in contact with a molten metal at the time of beginning of use of the vessel, a gas introduction pipe is occluded up to the tip, and the gas introduction pipe is opened by a quick exchange method are arranged on a bottom or a side wall of the molten metal refining vessel.

Patent Document 6 further proposes an operation method of the molten metal refining vessel in which in refining a molten metal by the molten metal refining vessel, after initially using any two of the gas blowing nozzles, other two gas blowing nozzles are used by the quick exchange method, the initially used nozzles are occluded, and about two nozzles as one pair are alternately used according to the number of use of the refining vessel.

However, in the case of the molten metal refining vessel and the operation method thereof of Patent Document 6, for example, in switching nozzles, a blind brick must de destroyed by drilling or the like. Furthermore, there is the problem that a series of exchange operation is troublesome in that works occur such that an iron shell at the first gas blowing nozzle side is removed, a refractory receiving nozzles is dismantled, and the space is filled with an amorphous refractory, and the efficiency is poor. Furthermore, there are the problems that a gap may be formed in the opening of tuyere and the gas blowing nozzle inserted, a molten metal may penetrate the gap, resulting in steel leakage, and reliability is low.

BACKGROUND ART

Patent Document

Patent Document 1: JP-UM-A-02-61950
Patent Document 2: JP-A-10-265829
Patent Document 3: JP-A-2003-231912
Patent Document 4: JP-A-2000-212634
Patent Document 5: JP-A-56-58918
Patent Document 6: JP-A-05-98337

SUMMARY OF THE INVENTION

Problems that the Invention is to Solve

The present invention has been made in view of the above actual circumstances, and has an object to provide a gas blowing nozzle that does not require to prolong a length of the nozzle itself, does not require to exchange the nozzle, does not require to open a standby nozzle when switching gas blowing, can extend the service life, and can apply to the existing refining facilities without greatly modifying those.

Means for Solving the Problems

To solve the above problems, the present inventors have made investigations on damage state of a gas blowing nozzle, and have obtained the following findings.

(1) The damage of a gas blowing nozzle is mainly abrasion of a refractory by molten metal flow caused by gas stirring, and is generally a damage that a gas discharge hole portion is greatly depressed in mortar-shaped. Finally, the service life is determined by that the residual thickness of a refractory (nozzle refractory) in the discharge hole portion is decreased.

(2) On the other hand, in a site about 200 mm or more apart from a center of the discharge hole portion, the degree of abrasion is small, and the residual thickness of the nozzle refractory is relatively large.

The present inventors have focused on that the service life of a nozzle is improved by effectively utilizing erosion difference in nozzle refractory depending on position, have made further investigations and experiments, and have reached to complete the present invention.

That is to say, the invention provides a gas blowing nozzle for blowing a gas to a molten metal in a furnace, comprising a plurality of narrow metal pipes for gas introduction, a surge tank storing a gas before blowing, and a refractory protecting the narrow metal pipes and the surge tank, the gas blowing nozzle comprising: a first nozzle section comprising a plurality of first narrow metal pipes having open furnace-side tips exposed to an inside of the furnace and being in the state of capable of blowing a gas to the molten metal in the furnace, a first surge tank communicated with the first narrow metal pipes, and a first refractory protecting the first narrow metal pipes and the first surge tank; and a second nozzle section comprising a plurality of second narrow metal pipes, a second surge tank communicated with the second narrow metal pipes, and a second refractory protecting the second narrow metal pipes and the second surge tank, in which furnace-side tips of the second narrow metal pipes are embedded in the second refractory such that the furnace-side tips of the second narrow metal pipes are located in a given depth and the furnace-side tips are occluded, wherein blowing of a gas from the first nozzle section is continuously conducted in the state of applying pressure of the gas to the second nozzle section, and when erosion of the second refractory reaches the furnace-side tips of the second narrow metal pipes embedded in the second refractory, occluded furnace-side tips of the second narrow metal pipes are opened, and blowing of a gas from the second narrow metal pipes is started.

Also, according to the gas blowing nozzle of the invention, it is preferable that the first narrow metal pipes and the second narrow pipes are arranged at intervals of from 100 to 1,000 mm in the closest portion.

Moreover, it is preferable that the second narrow metal pipes are embedded in a depth such that a distance from a surface of the second refractory to the furnace-side tips is 14% or more of a nozzle effective length.

Also, the invention provides a gas blowing nozzle for blowing a gas to a molten metal in a furnace, comprising a plurality of narrow metal pipes for gas introduction, a surge tank communicated with the plurality of the narrow metal pipes and storing a gas before blowing, and a refractory protecting the narrow metal pipes and the surge tank, wherein the narrow metal pipes are embedded in the refractory such that furnace-side tips thereof are located in a given depth, and the furnace-side tips are occluded.

Moreover, it is preferable that the narrow metal pipes are embedded in a depth such that a distance from a surface of the refractory to the furnace-side tips is 14% or more of a nozzle effective length.

Advantage of the Invention

The gas blowing nozzle of the present invention comprises:

(a) a first nozzle section comprising a plurality of first narrow metal pipes having open furnace-side tips exposed to an inside of the furnace and being in a state capable of blowing a gas to a molten metal in the furnace, and a first surge tank communicated with the first narrow metal pipes, and (b) a second nozzle section comprising a plurality of second narrow metal pipes embedded in a refractory and having occluded surface-inside tips, and a second surge tank communicated with the second narrow metal pipes, and is constituted such that when erosion of a second refractory reaches the furnace-side tips of the second narrow metal pipes by that the blowing of a gas from the first nozzle section is continuously conducted, occluded furnace-side tips of the second narrow metal pipes are opened, and the blowing of a gas from the second narrow metal pipes of the second nozzle section is started. Therefore, at the time that the first narrow metal pipes constituting the first nozzle section from which a gas has been blown and the first refractory have worn down up to a given line, a gas blowing passage is switched to gas blowing from the second nozzle section (in detail, from the furnace-side tips of the second narrow metal pipes) in which the degree of erosion of the refractory is minor as compared with the vicinity of the discharge hole of the first nozzle section, and as a result, the service life can be prolonged by effectively utilizing the above-described erosion difference of refractory by position.

Incidentally, in the case of the gas blowing nozzle of the present invention, the first nozzle section and the second nozzle section each are equipped with a surge tank communicated with the narrow metal pipes. Therefore, by connecting a gas supply line to each surge tank, supply passage of the gas can be switched easily and securely without conducting particularly complicated treatment at the time that aeration from the second nozzle section has been confirmed.

Incidentally, the present invention defines the gas blowing nozzle comprising the first nozzle section and the second nozzle section, but the gas blowing nozzle can have the constitution further comprising nozzle sections of a third nozzle section and the subsequent nozzle sections such that the nozzle further comprises a third nozzle section comprising third narrow metal pipes embedded in the refractory at a position deeper than the furnace-side tips of the second narrow metal pipes, a third surge tank communicated with the third narrow metal pipes, and a third refractory; and a fourth nozzle section comprising fourth narrow metal pipes embedded in the refractory at a position deeper than the third narrow metal pipes, a fourth surge tank communicated with the fourth narrow metal pipes, and a fourth refractory.

That is, the present invention is essential that the nozzle comprises at least the first and second nozzle sections, and does not exclude the constitution further comprising a third nozzle section and the subsequent nozzle sections.

Moreover, in the present invention, the furnace-side tips of the second narrow metal pipes embedded in the refractory are occluded, but the furnace-side tips may be constituted such that the tips are occluded by embedding in the refractory, and the second narrow metal pipes having the furnace-side tips preliminarily occluded may be embedded in the refractory.

Incidentally, in the case that the furnace-side tips have been constituted such that the tips are occluded by embedding in the refractory, the blowing of a gas is started at the time that erosion of the refractory has reached the furnace-side tips of the second narrow metal pipes. On the other hand, in the case that the second narrow metal pipes having the furnace-side tips preliminarily occluded have been embedded in the refractory, the furnace-side tips open by contacting a molten metal, and the blowing of a gas is started at that time.

Moreover, the gas blowing nozzle of the present invention can further improve durability by further surely utilizing erosion difference of the refractory by position by that the first narrow metal pipes constituting the first nozzle section and the second narrow metal pipes constituting the second nozzle section are arranged at intervals of from 100 to 1,000 mm in the closest portion.

Incidentally, the first narrow metal pipes and the second narrow metal pipes here each mean narrow metal pipes communicated with the surge tank and actually aerating a gas.

In addition, when the interval between the first narrow metal pipes and the second narrow metal pipes in the closest portion is less than 100 mm, it becomes difficult to sufficiently utilize erosion difference of the refractory. When the interval exceeds 1,000 mm, not only workability is deteriorated, but refining efficiency is decreased or erosion form of the refractory in the entire refining furnace is remarkably deteriorated. Therefore, the interval between the first narrow metal pipes and the second narrow metal pipes in the closest portion is desirably a range of from 100 to 1,000 mm.

Also, the interval between the first narrow metal pipes and the second narrow metal pipe means a distance between the closest narrow metal pipes among the narrow metal pipes constituting the first narrow metal pipes and the narrow metal pipes constituting the second narrow metal pipes in the case of seeing the narrow metal pipes from an axial direction.

Additionally, in the case that the second narrow metal pipes constituting the second nozzle section are embedded a depth (embedded depth) such that the distance from the surface of the second refractory to the furnace-side tips is 14% or more of the nozzle effective length, the erosion difference of the refractory by the position can further securely be utilized, thereby the present invention can further effectively be carried out.

Incidentally, in the present invention, the nozzle effective length does not mean the entire length of the first and second refractories, but means a length that the nozzle can safely be used with a safe residual thickness. Explaining by referring to FIG. 5, when a distance from the upper ends of the first and second surge tanks 12 and 22 to the surfaces (upper end surfaces) 13*a* and 23*a* of the first and second refractories 13 and 23 is the entire length L (mm) of the first and second refractories, the safe residual thickness means the value obtained by subtracting 300 mm from the L (mm), that is, the value represented by the following formula (1).

$$\text{Nozzle effective length (mm)} = L\ (\text{mm}) - 300\ \text{mm} \quad (1)$$

Incidentally, in the case that the embedded depth (D in FIG. 1) of the second narrow metal pipes constituting the second nozzle section is shorter than 14% of the nozzle effective length, the period of switching to the second nozzle section from the first nozzle section is too early, and the nozzle effective length of the first nozzle section cannot sufficiently be utilized. As a result, the life as the entire gas blowing nozzle cannot sufficiently be prolonged.

Furthermore, crack and peeling may occur on the surface of the refractory in the initial stage of operation by thermal spalling, thermal expansion stress and the like. In the case that the embedded length of the second narrow metal pipes is shorter than 14% of the nozzle effective length, the tips of the second narrow metal pipes may be exposed by the crack and peeling in the initial stage of operation.

Therefore, the embedded length of the second narrow metal pipes constituting the second nozzle section is desirably 14% or more of the nozzle effective length.

Furthermore, the gas blowing nozzle of the present invention has the constitution that in the gas blowing nozzle for blowing a gas to a molten metal in a furnace, comprising a plurality of narrow metal pipes for gas introduction, a surge tank storing a gas before blowing, and a refractory protecting the narrow metal pipes for gas introduction and the surge tank, the narrow metal pipes are embedded in the refractory such that the furnace-side tips are located in a given depth, and the furnace-side tips are occluded.

Therefore, the gas blowing nozzle of the present invention can have the same constitution as the gas blowing nozzle comprising the first nozzle section and the second nozzle section, and can constitute a gas blowing nozzle achieving the same effects, by using in combination with the conventional gas blowing nozzle, that is, a gas blowing nozzle comprising a plurality of narrow metal pipes having open furnace-side tips exposed in the furnace and being in a state capable of blowing a gas to a molten metal in the furnace, and a surge tank communicated with the narrow metal pipes.

Moreover, when the narrow metal pipes are embedded in a depth such that a distance from the surface of a refractory to the furnace-side tips is 14% or more of the nozzle effective length, durability can further be improved by further surely utilizing the erosion difference by position.

MODE FOR CARRYING OUT THE INVENTION

The characteristics of the present invention are described in further detail below by reference to the embodiments of the present invention.

(Embodiment 1)

Figure 1:
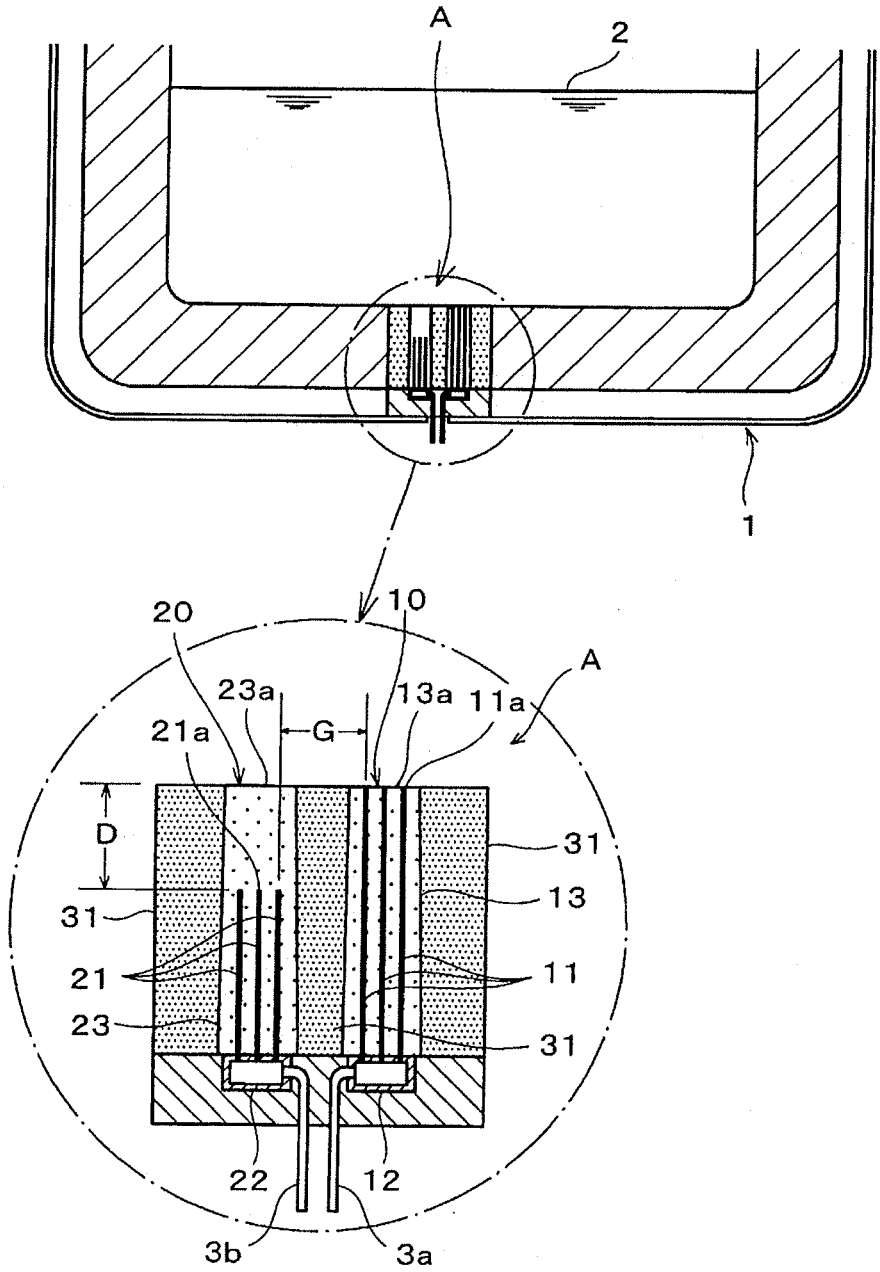
FIG. 1 is a front cross-sectional view schematically showing the state that the gas blowing nozzle according to the embodiment 1 of the present invention has been incorporated in the bottom of a molten metal refining vessel (refining furnace).
Figure 7:
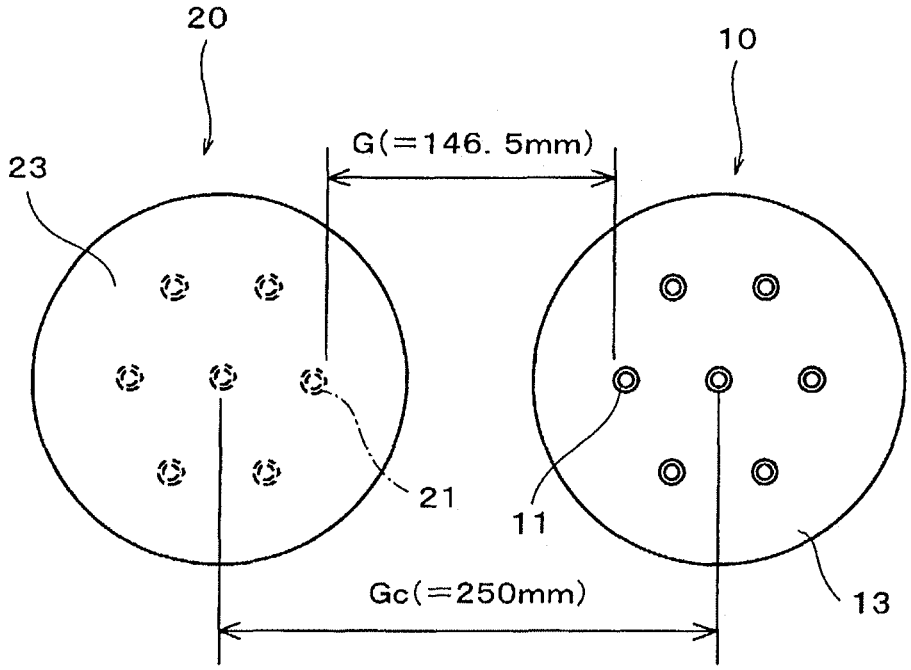
FIG. 7 is a view for explaining an interval (distance) between first narrow metal pipes and second narrow metal pipes, in the gas blowing nozzle according to the embodiment 1 of the present invention.

FIG. 1 is a front cross-sectional view schematically showing the state that the gas blowing nozzle according to one embodiment (embodiment 1) of the present invention has been incorporated in the bottom of a molten metal refining vessel (refining furnace), and FIGS. 2 to 5 are front cross-sectional views showing constitution and use embodiment of the gas blowing nozzle according to the embodiment 1 of the present invention. Furthermore, FIG. 7 is a view seeing first narrow metal pipes and second narrow metal pipes of the gas blowing nozzle according to the embodiment 1 of the present invention from the upper part.

As shown in FIG. 1, a gas blowing nozzle A of the embodiment 1 is a gas blowing nozzle for blowing a gas to a molten metal 2 in a refining furnace 1 such as an electric furnace or a converter. The gas blowing nozzle is equipped with a first nozzle section 10 comprising a plurality of first narrow metal pipes 11 having open furnace-side tips 11*a* that are exposed to the inside of the furnace and being in the state of capable of blowing a gas to the molten metal 2 in the furnace, a first surge tank 12 communicated with the first narrow metal pipes 11, and a first refractory 13 protecting the first narrow metal pipes 11 and the first surge tank 12.

Furthermore, the gas blowing nozzle A is further equipped with a second nozzle section 20 comprising a plurality of second narrow metal pipes 21, a second surge tank 22 communicated with the second narrow metal pipes 21, and a second refractory 23 protecting the second narrow metal pipes 21 and the second surge tank 22.

And, in the second nozzle section 20, the second narrow metal pipes 21 are embedded in the second refractory 23 such that furnace-side tips 21*a* thereof are located in a given depth, and the furnace-side tips 21*a* are occluded by being embedded in the second refractory 23.

Figure 6A:
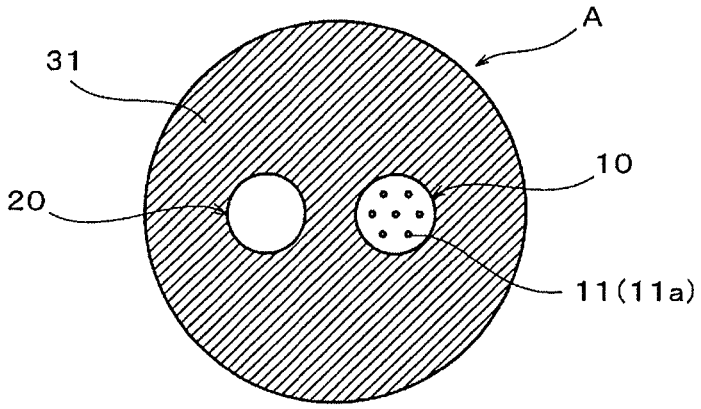
FIGS. 6 are views showing the constitution of the gas blowing nozzle according to the embodiment 1 of the present invention, wherein FIG. 6(*a*) is a plane view showing the constitution of the gas blowing nozzle of the embodiment 1, FIG. 6(*b*) is a plane view showing a modification example, and FIG. 6(*c*) is a plane view showing other modification example.
Figure 6B:
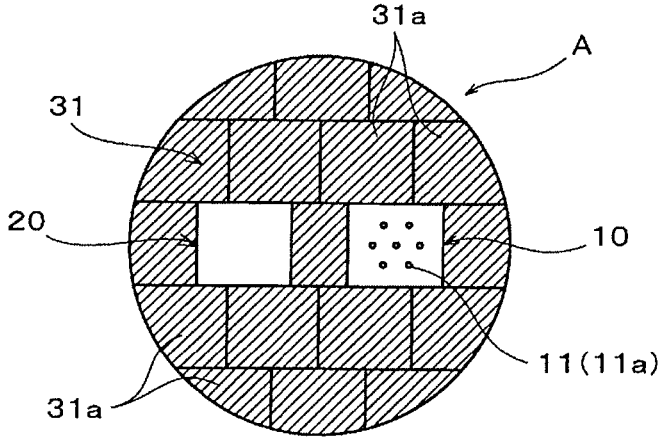
Figure 6C:
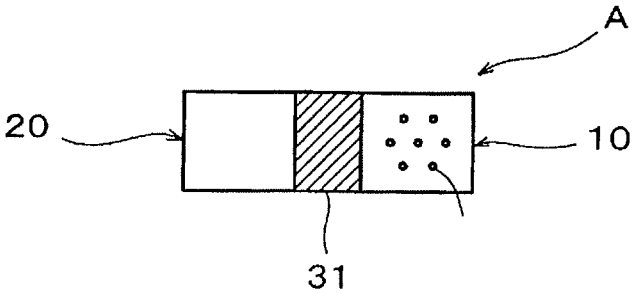

And, the first nozzle section 10 and the second nozzle section 20 are integrally held by a support refractory 31. The support refractory 31 in the embodiment 1 is, for example, a structure comprising a plurality of support bricks combined into one unit so as to surround the peripheries of the first nozzle section 10 and the second nozzle section 20. FIG. 6(*a*) shows a plane structure (plane view) of the gas blowing nozzle A according to the embodiment 1 of the present invention, comprising the first nozzle section 10 and the second nozzle section 20 that are integrally held by the support refractory 31.

A structure (support refractory 31) integrally holding the first and second nozzle sections can be formed by combining refractory members divided into several pieces. FIG. 6(*b*) shows such an example, and shows the example that the refractory members 31*a* divided into several pieces, each having a rectangular planar shape, are combined to form a structure (support refractory 31) integrally holding the nozzle section 10 and the nozzle section 20 each having the similar rectangular planar shape. Fabrication of the structure can be conducted simultaneously when constructing in the furnace.

Moreover, FIG. 6(*c*) shows other example of the gas blowing nozzle of the present invention. In this example, the first nozzle section 10 and the second nozzle section 20 each having a rectangular planar shape are bonded by the support refractory 31 having the similar rectangular planar shape to form an integrated structure.

Incidentally, FIG. 6(*a*) shows the case that the first nozzle section 10 and the second nozzle section 20 have a circular planar shape (that is, columnar shape in three-dimensional shape), and FIG. 6(*b*) and FIG. 6(*c*) show the case that the first nozzle section 10 and the second nozzle section 20 have a nearly square-shaped planar shape (that is, rectangular solid shape in three-dimensional shape). However, in the gas blowing nozzle of the present invention, the shape of the first nozzle section 10 and the second nozzle section 20 is not particularly limited.

In addition, in the gas blowing nozzle A of the embodiment 1 shown in FIGS. 1 to 4, the first narrow metal pipes 11 of the first nozzle section 10 and the second narrow metal pipes 21 of the second nozzle section 20 are arranged at intervals (G in FIG. 1) of 146.5 mm (the preferred range in the present invention is from 100 to 1,000 mm) in the closest portion as shown in FIG. 7. Incidentally, in this case, the interval between the middle (the center) of the first nozzle section 10 and the middle (the center) of the second nozzle section is 250 mm as shown in FIG. 7.

Figure 5:
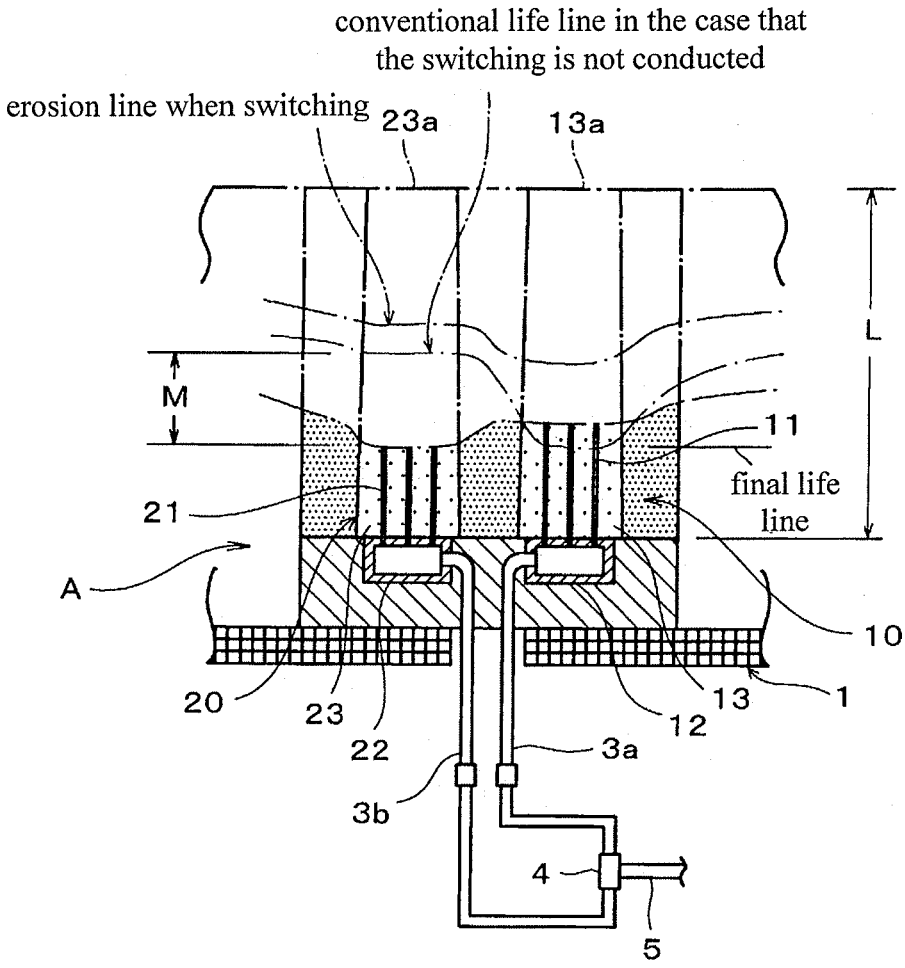
FIG. 5 is a view showing a use embodiment of the gas blowing nozzle according to the embodiment 1 of the present invention, and is a front cross-sectional view showing the state that a first refractory and a second refractory have worn and reached a final life line.

Moreover, the second narrow metal pipes 21 constituting the second nozzle section 20 are embedded in a depth such that a distance (embedded depth) (D in FIG. 1) from the surface of the second refractory 23 to the furnace-side tips 21*a* is 14% or more of the nozzle effective length (=L (mm)–300 mm) (FIG. 5). Incidentally, in the Examples described hereinafter, the distance (D) from the surface of the second refractory to the furnace-side tips is 145 mm, the nozzle effective length is about 350 mm, and the distance from the surface of the refractory to the furnace-side tips is about 41% of the nozzle effective length.

Figure 2:
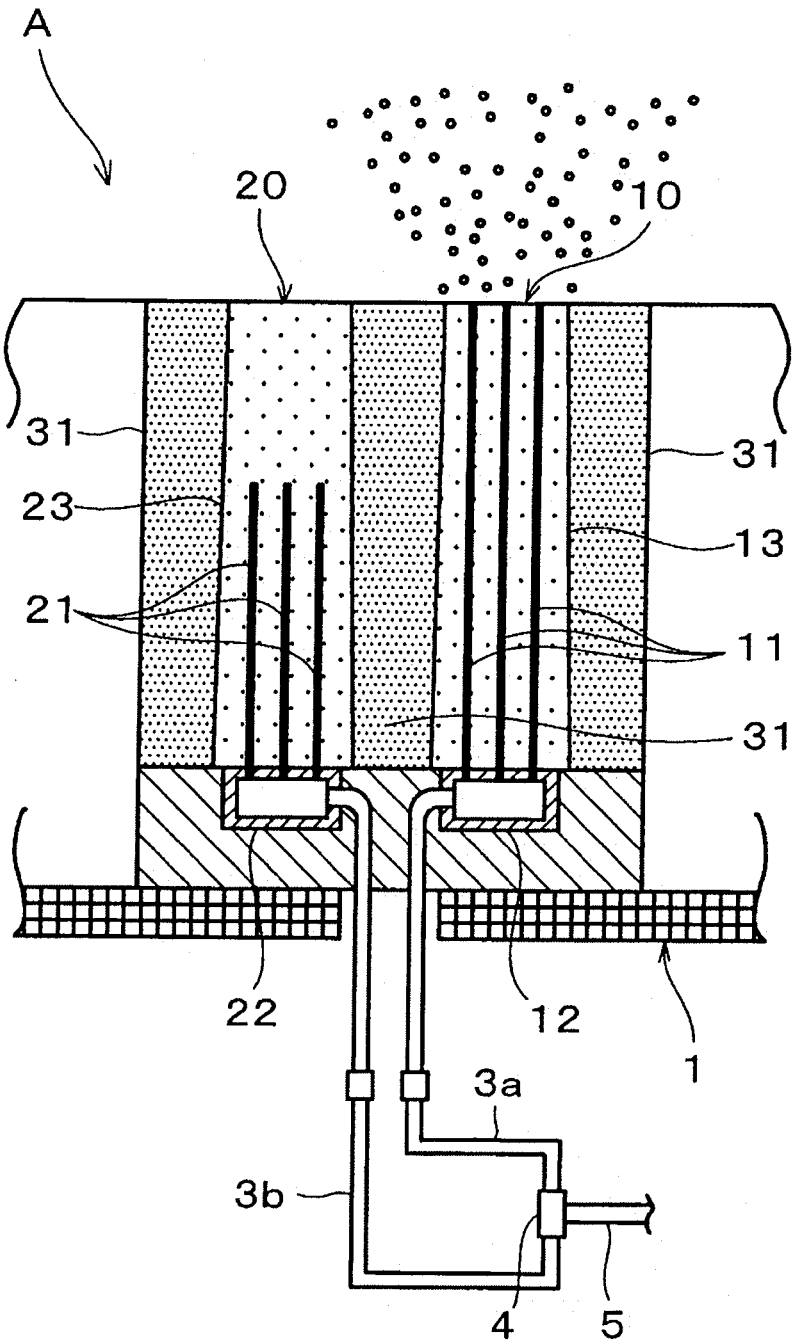
FIG. 2 is an enlarged front cross-sectional view showing the gas blowing nozzle according to the embodiment 1 of the present invention, incorporated in the bottom of a refining furnace.

Also, gas supply lines 3*a* and 3*b* are connected to the first surge tank 12 and the second surge tank 22, respectively, and each of the gas supply lines 3*a* and 3*b* is connected to a gas piping 5 through a pipe joint 4 (FIG. 2).

Incidentally, in order that operation is conducted by simultaneously applying gas pressure to the first nozzle section 10 and the second nozzle section 20 and a gas can be supplied to only the second nozzle section when switching, the first and second nozzle sections 10 and 20 must be equipped with the respective surge tanks as described above. As the case may be, it is possible to respond by partitioning one surge tank with a partition member.

Moreover, it is necessary to connect a gas supply line (gas piping for gas introduction) to each surge tank. The piping attached to the respective surge tanks can be curved or bent. Therefore, the gas supply line (gas piping for gas introduction) can easily be connected to the surge tank without modification to increase a size of the existing hole for nozzle installation provided in a refining furnace and extra effort of complicated construction.

Therefore, the gas blowing nozzle of the present invention can be attached to the existing refining furnace and can improve its durability.

Incidentally, specific constitution of the first surge tank 12 and the second surge tank 22, specific connection embodiment of a line for supplying a gas to each surge tank, and the like are not particularly restricted.

Also, stainless steel, common steel, heat-resistant steel or the like can be used as materials constituting the first and second narrow metal pipes 11 and 21. Of those, stainless steel is particularly preferred.

Moreover, the inner diameter of the first and second narrow metal pipes 11 and 21 is preferably from about 1 to 4 mm, and its thickness is desirably from about 1 to 2 mm. The reason for this is as follows. When the inner diameter of the first and second narrow metal pipes 11 and 21 is less than 1 mm, the narrow metal pipes are occluded, and a gas may not sufficiently be supplied to a molten metal. When the inner diameter exceeds 4 mm, a molten metal enters the first and second narrow metal pipes 11 and 21, and steel leakage may occur.

Also, in order to suppress carburization phenomenon, the conventional constitution such that an oxide layer can be sprayed to the first and second narrow metal pipes 11 and 21, or a coating material such as MgO is applied thereto, can be employed.

Moreover, the refractory protecting the narrow metal pipes is not particularly limited so long as it has fire resistance. Preferably, a carbon-containing refractory such as MgO—C refractory, $Al_2O_3$—C refractory, $Al_2O_3$—SiC—C refractory, MgO—CaO—C refractory or MgO—$Al_2O_3$—C refractory can be used. MgO—C brick containing from 10 to 25% by weight of graphite as a carbon content is further preferably used.

Also, a method for producing the carbon-containing refractory can use the conventional production methods, and comprises adding carbonaceous raw materials to fire-resistant aggregates, if necessary adding a metal powder and other additives, adding a binder for forming a carbon bond, such as a phenol resin, pitch or tar, in an amount of from 1 to 15% by weight and preferably from 3 to 8% by weight, kneading the resulting mixture, molding the mixture, and then heat-treating the resulting molding at from 100 to 500° C., and preferably from 150 to 400° C., to obtain an unburned brick.

Alternatively, after molding, the resulting molding can be burned at from 500 to 1,500° C., and preferably from 800 to 1,300° C., in a reducing atmosphere to obtain a burned brick.

Next, operation in the case of blowing a gas to the molten metal 2 in the refining furnace 1 having arranged therein the gas blowing nozzle A constituted as above is described below.

First, as shown in FIG. 2, a gas is blown from the first narrow metal pipes 11 constituting the first nozzle section 10 in the state that pressure of a gas has been applied to the occluded second narrow metal pipes 21 constituting the second nozzle section 20.

When the refining furnace 1 is continuously operated in this state, the first narrow metal pipes 11 constituting the first nozzle section 10, and the first refractory 13 gradually wear down, and along with it, the second refractory 23 constituting the second nozzle section 20 also wears down although milder than the first refractory 13.

Figure 3:
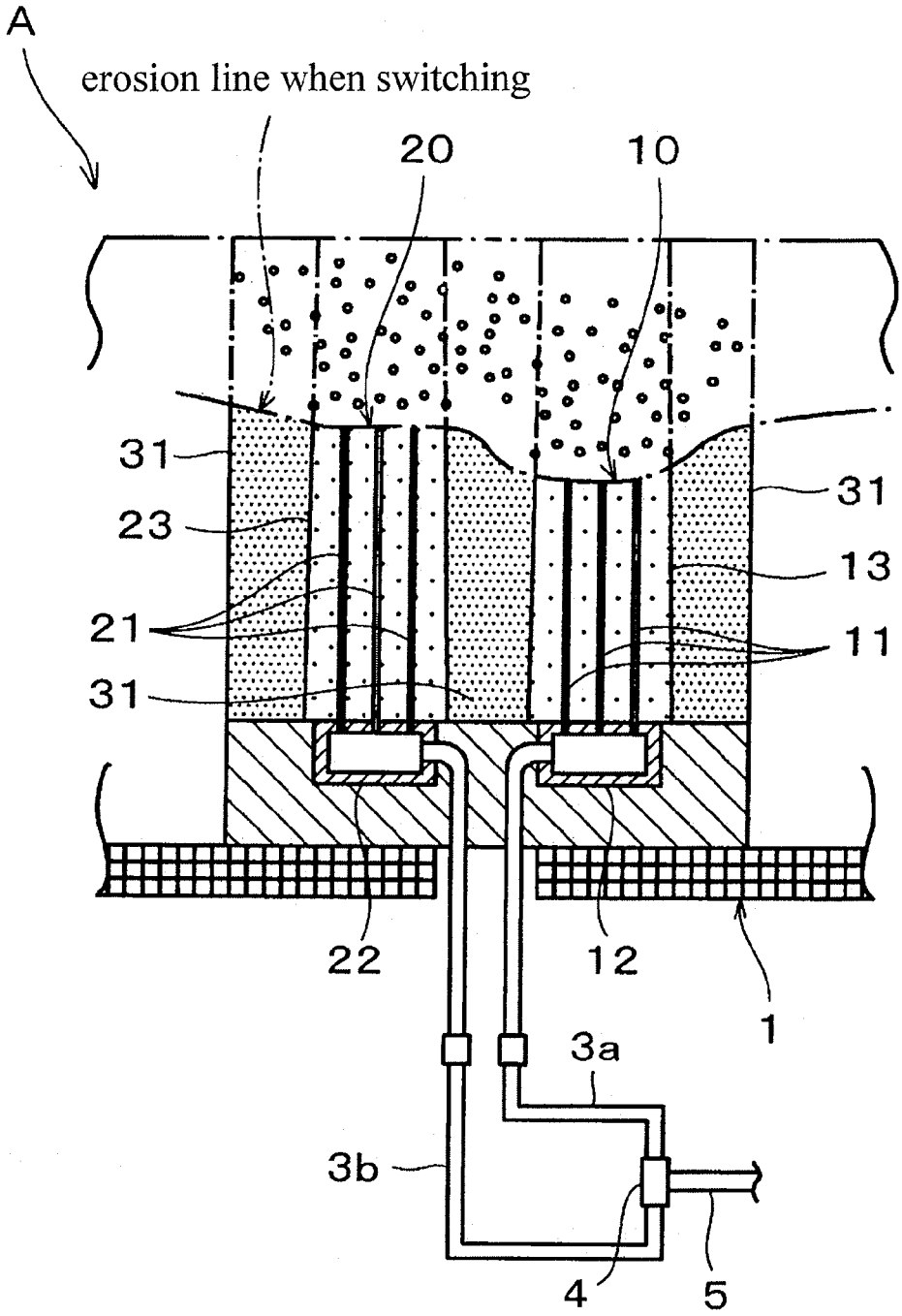
FIG. 3 is a view showing a use embodiment of the gas blowing nozzle according to the embodiment 1 of the present invention, and is a front cross-sectional view showing the state that aeration of a gas from a second nozzle section has been started.

And, as shown in FIG. 3, when the erosion of the second refractory 23 proceeds to the position of the occluded furnace-side tips 21*a* of the second narrow metal pipes 21, the furnace-side tips of the second narrow metal pipes, that are occluded by the second refractory 23 is opened, and the blowing of a gas from the second narrow metal pipes 21 of the second nozzle section 20 is started. The erosion line of the refractory in this case becomes an erosion line when switching.

Here, the fact that the blowing (aeration) of a gas from the second narrow metal pipes 21 having the occluded furnace-side tips 21*a* is started can easily and surely be detected by, for example, detection of a pressure by a pressure gauge or a method of visually confirming the movement of residual melt (molten metal 2) in the refining furnace 1.

Furthermore, if a system is constructed such that a pressure gauge detects pressure drop and an alarm sounds, the initiation of the blowing of a gas can further surely been detected.

After confirming the aeration from the second narrow metal pipes 21, the supply of a gas to the first narrow metal pipes 11 of the first nozzle section 10 that has blown a gas until then is stopped.

In stopping the supply of a gas to the first narrow metal pipes 11 in such a case, a valve (not shown) that stops the supply of a gas to the first narrow metal pipes 11 via the gas supply line 3*a* is manually or automatically operated to stop the supply of a gas to the gas supply line 3*a* while maintaining the supply to the gas supply line 3*b*, thereby easily switching to the blowing of a gas from the second narrow metal pipes 21 of the second nozzle section 20 having residual thickness.

Also, although not particularly shown, the switching operation can be conducted in a short period of time by temporarily stopping a gas during periodic repair, disconnecting the piping of the gas supply line 3*a* at the first nozzle section 10 side, and putting a cap at the pipe joint 4 side.

Figure 4:
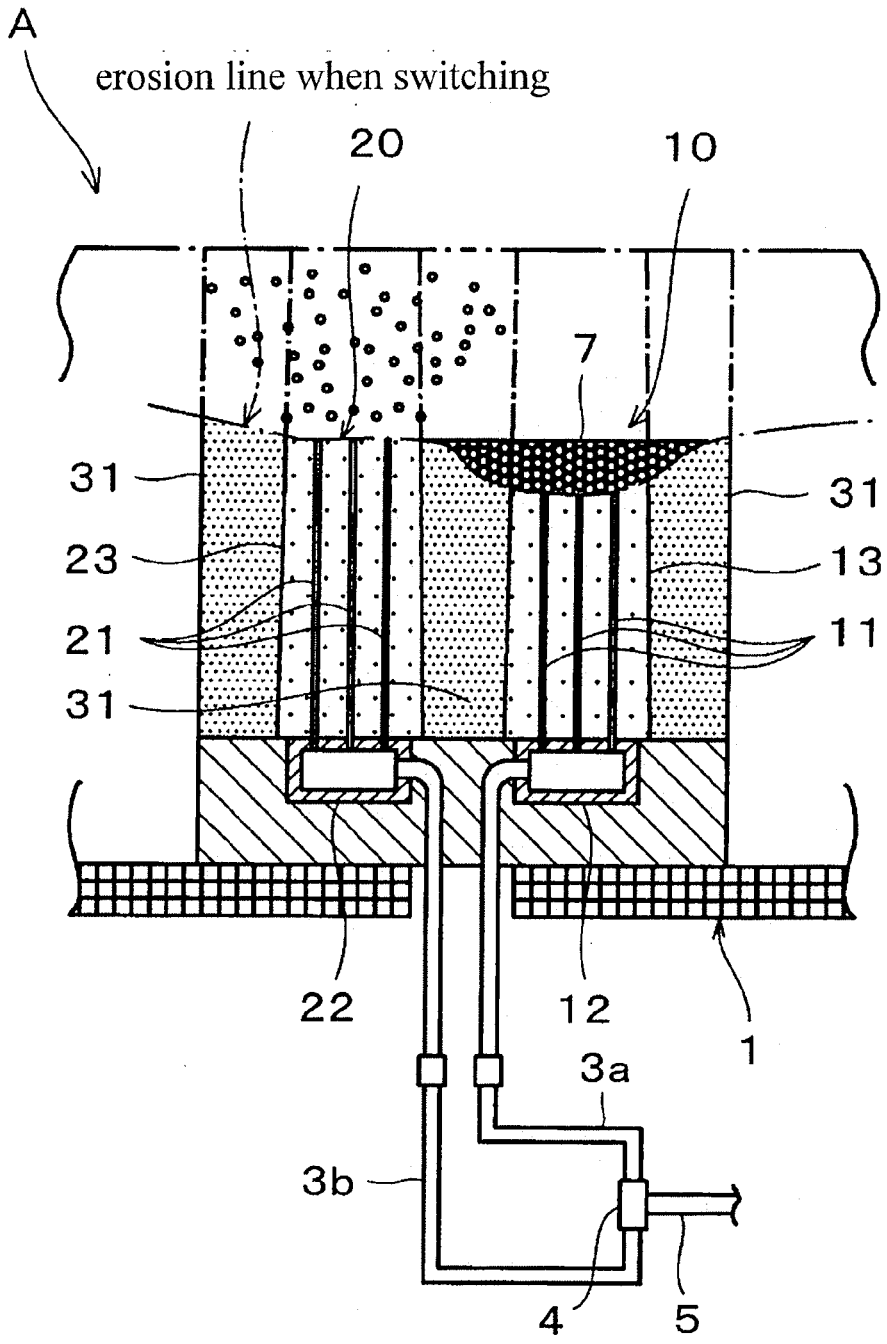
FIG. 4 is a view showing a use embodiment of the gas blowing nozzle according to the embodiment 1 of the present invention, and is a front cross-sectional view showing the state that after switching to the blowing of a gas from a second nozzle section, the blowing of a gas from the first nozzle section is stopped and the vicinity of a discharge hole is embedded with an amorphous refractory.

Then, as shown in FIG. 4, repair is conducted that the depressed portion in the vicinity of the gas discharge portion on the upper surface of the first refractory 13 constituting the first nozzle section 10 is filled with an amorphous refractory 7. However, as the case may be, the repair of filling with the amorphous refractory is not conducted, and the depressed portion may be left as it is.

Thereafter, by conducting the blowing of a gas from the second narrow metal pipes 21 of the second nozzle section 20, the refining furnace 1 can continuously be operated until the first refractory 13 and the second refractory 23 wear down and the surface of any one of those reaches the final life line (see FIG. 5).

Incidentally, FIG. 5 shows the state that the second refractory 23 of the second nozzle section 20 has worn down until reaching the final life line. FIG. 5 further shows:

(1) erosion line at the time of the switching between the first nozzle section 10 and the second nozzle section 20, (2) life line in the case that the switching between the first nozzle section 10 and the second nozzle section 20 is not conducted (life line in the case of using the conventional gas blowing nozzle), (3) life line in the case that the switching between the first nozzle section 10 and the second nozzle section 20 is conducted, (4) entire length (L) of the first and second refractories 13 and 23, and (5) erosion difference (M) by position.

As shown in FIG. 5, it is understood that by conducting the switching between the first nozzle section 10 and the second nozzle 20 as in the case of the embodiment 1, the service life can be prolonged by utilizing the difference in the final life line between the case that the switching has been conducted and the case that the switching is not conducted, that is, erosion difference (residual thickness difference) M.

Moreover, in the case of using the gas blowing nozzle A of the embodiment 1, for example, the existing piping at the refining furnace 1 side can be diverged into two or more pipings by the commercially available pipe joint, and can be utilized as it is. As a result, the gas blowing nozzle A can be attached without great modification of the existing facilities, and durability can be improved without great modification costs.

(Embodiment 2)

Figure 9:
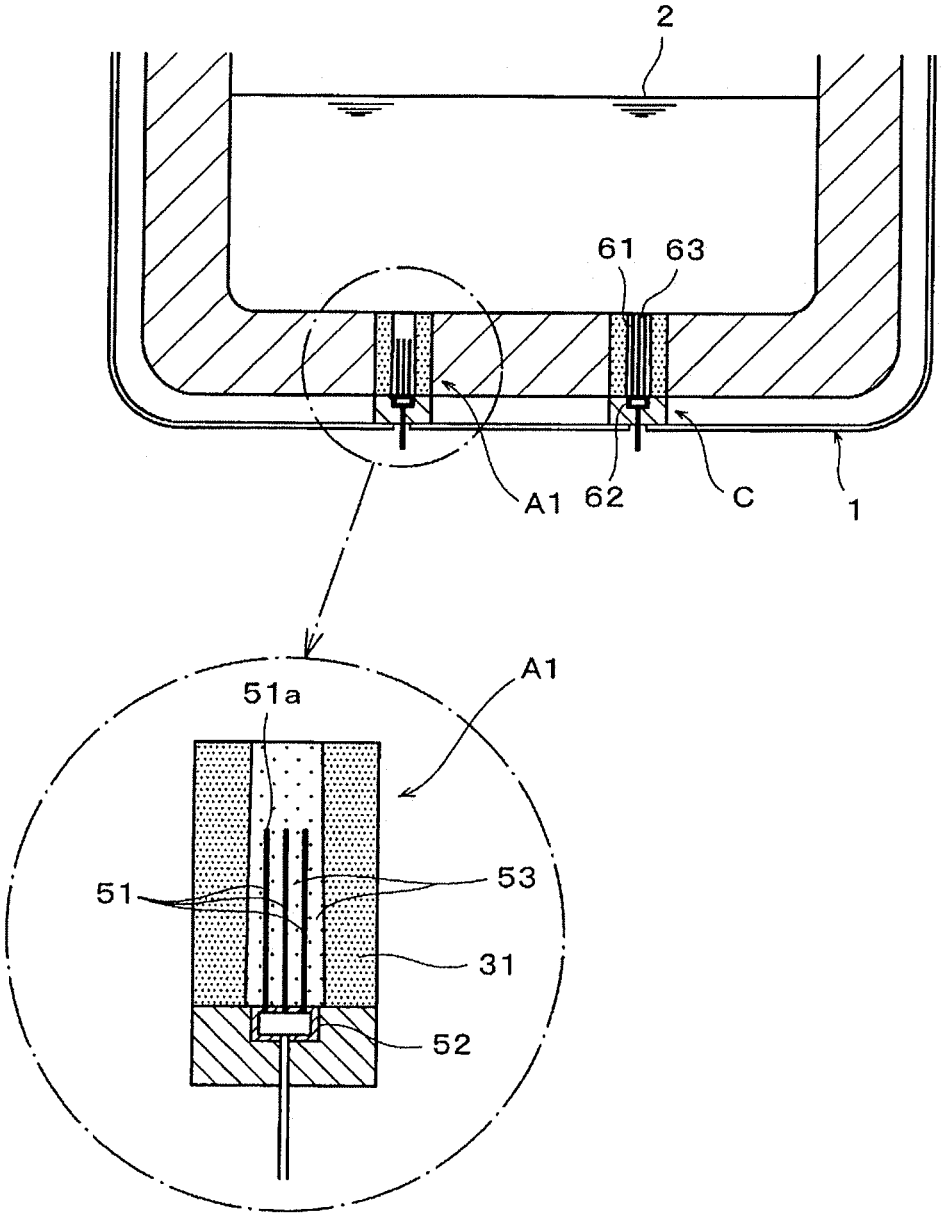
FIG. 9 is a view schematically showing the state that the gas blowing nozzle according to the embodiment 2 of the present invention has been incorporated in the bottom of a molten metal refining vessel (refining furnace).

FIG. 9 is a view schematically showing the state that the gas blowing nozzle A1 according to the other embodiment (embodiment 2) of the present invention has been incorporated in the bottom of a molten metal refining vessel (refining furnace).

The gas blowing nozzle A1 of the embodiment 2 comprises a plurality of narrow metal pipes 51 for gas introduction, a surge tank 52 storing a gas before blowing, and a refractory 53 protecting the narrow metal pipes 51 for gas introduction and the surge tank 52. The narrow metal pipes 51 have the constitution that furnace-side tips 51*a* thereof are embedded in the refractory 53 so as to locate in a given depth, and the furnace-side tips 51*a* are occluded.

Incidentally, that is, the gas blowing nozzle A1 of the embodiment 2 has the same constitution as the second nozzle section 20 in the gas blowing nozzle A of the embodiment 1 above.

In FIG. 9, portions having the same reference numerals and signs as in FIG. 1 show the same or corresponding portions.

As shown in FIG. 9, the gas blowing nozzle A1 of the embodiment 2 is constituted so as to be used by arranging in the bottom of the refining furnace 1 in combination with a gas blowing nozzle having the same constitution as the first nozzle section 10 (FIGS. 2 to 4) constituting the gas blowing nozzle A of the embodiment 1, that is, a gas blowing nozzle C comprising narrow metal pipes 61, a surge tank 62 and a refractory 63, and having a constitution that the narrow metal pipes 61 penetrate through the refractory 63.

Then, in the case of the constitution shown in FIG. 9, the gas blowing nozzle C performs the function of the first nozzle section 10 in the gas blowing nozzle A of the embodiment 1, and the gas blowing nozzle A1 of the embodiment 2 performs the function of the second nozzle section 20 in the gas blowing nozzle A of the embodiment 1. As a result, the same effect as in the embodiment 1 can be obtained.

By using the gas blowing nozzle A1 in combination with the gas blowing nozzle C having the same constitution as the first nozzle section 10 constituting the gas blowing nozzle A of the embodiment 1, those nozzles can be arranged at distant positions or arranged adjacently such that the gas blowing nozzle A1 (corresponding to the second nozzle section) and the gas blowing nozzle C has optional position positional relationship, and as a result, the degree of freedom of the arrangement embodiment can be improved.

However, those nozzles are desirably arranged so as to be adjacent from the standpoint of simplification of gas piping and switching mechanism The embodiment 1 has been described by reference to the case that an argon gas is blown from the gas blowing nozzle, but the kind of a gas is not particularly limited, and the gas blowing nozzle of the present invention can be used in the case of blowing other gases such as a nitrogen gas.

EXAMPLES

Example

As in the embodiment 1, the gas blowing nozzle constituted as shown in FIGS. 1 to 5 was used in the refining furnace 1, and the service life was examined. Incidentally, as the gas blowing nozzle A for examining the service life, specifically, the first nozzle section 10, a nozzle section having the constitution that seven first narrow metal pipes 11 comprising stainless steel pies each having an inner diameter of 1.5 mm and a thickness of 1 mm that penetrate through the first refractory 13 are connect to the first surge tank 12 was used.

Also, as the second nozzle section 20, a nozzle section having the constitution that the second narrow metal pipes 21 comprising stainless steel pipes each having an inner diameter of 1.5 mm and a thickness of 1 mm, and having a length shorter than the length of the first narrow metal pipes 11 have been connected to the surge tank 22 such that the position of the furnace-side tips 21*a* is a depth position of 145 mm from the surface of the second refractory 23 was used. The depth is about 41% of the nozzle effective length (about 350 mm).

Moreover, the interval between the first narrow metal pipes 11 constituting the first nozzle section 10 and the second narrow metal pipes 21 constituting the second nozzle section 20 was 146.5 mm in the closest portion.

Furthermore, MgO—C refractory containing 15% by weight of graphite was used as the first refractory 13 and the second refractory 23.

Comparative Example

Figure 8:
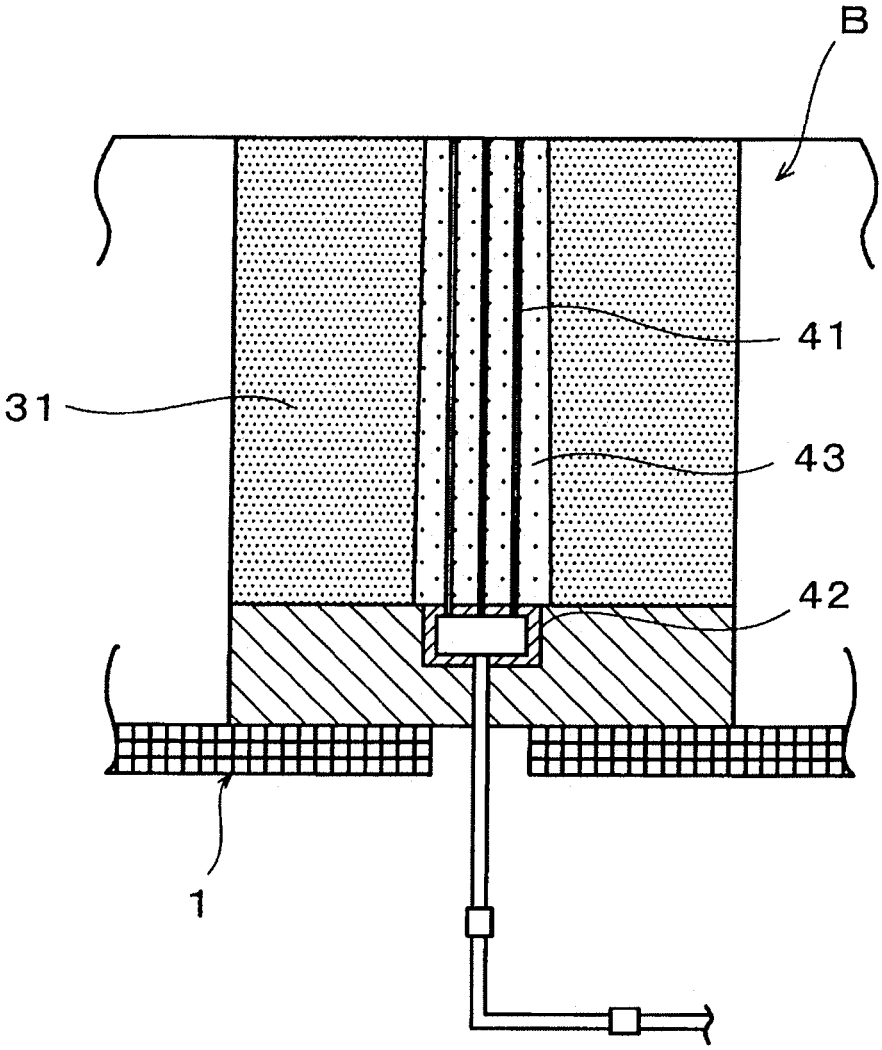
FIG. 8 is a front cross-sectional view showing the constitution of a gas blowing nozzle prepared for comparison, in the embodiment 1 of the present invention.

For the sake of comparison, a gas blowing nozzle B having the constitution corresponding to the first nozzle section of the gas blowing nozzle of the embodiment 1 of the present invention, as shown in FIG. 8, was prepared, and the service life in the case of using the same was examined.

The gas blowing nozzle B of the Comparative Example is the conventional gas blowing nozzle that does not have the second nozzle section in the present invention, and as a plurality of narrow metal pipes 41, a surge tank 42, and a refractory 43 protecting the first narrow metal pipes and the first surge tank, those comprising the same materials as used in the gas blowing nozzle A according to the embodiment 1 of the present invention were used. That is, the gas blowing nozzle B of the Comparative Example corresponds to the first nozzle section 10 in the gas blowing nozzle A of the embodiment 1 of the present invention. Incidentally, the nozzle effective length of the gas blowing nozzle B of the Comparative Example is 350 mm. Incidentally, in FIG. 8, portions having the same reference numerals and signs as in FIG. 1 show the same or corresponding portions.

The gas blowing nozzle A of the Example and the gas blowing nozzle B of the Comparative Example were arranged in a furnace bottom of an electric furnace having a molten steel amount of 100 tons, an argon gas was blown in a flow rate of 100 NL/min, and the respective service lives were examined. The service life was measured using the conventional measurement method. That is, the life of a nozzle was determined by detecting a temperature with a thermocouple embedded in a nozzle refractory. The measurement method has the mechanism that when a refractory wears down and the remaining size of the refractory is decreased, a distance between an operating surface and the thermocouple embedded becomes short and a temperature detected by the thermocouple is increased. Specifically, scraps were melted in an electric furnace having each of the nozzle of the Example and the nozzle of the Comparative Example arranged therein, an argon gas was blown to conduct a treatment, and a molten metal was transferred to a molten metal vessel. A series of those steps was considered as 1 ch (Charge), and the steps were repeatedly conducted. The number of repetition of the steps when a temperature detected by the thermocouple reached about 1,000° C. was considered as the service life of a nozzle.

(Test Results)

As a result of tests, the service life of the gas blowing nozzle of the Comparative Example was about 700 ch.

On the other hand, in the gas blowing nozzle of the Example, the blowing of a gas by the first nozzle section was switched to the blowing of a gas by the second nozzle section at 500 ch, and the nozzle effective length was reached at further 319 ch.

That is, whereas the service life was about 700 ch in the case of using the gas blowing nozzle of the Comparative Example, the service life was prolonged to 819 ch in the case of using the gas blowing nozzle of the Example. It was confirmed that the service life improves about 17%.

The present invention is not limited to the above Example and Comparative Example in other points, and various changes and modifications can be made without departing from the spirit and scope of the invention.

The present application is based on Japanese Patent Applications No. 2010-153958 filed on Jul. 6, 2010, and the contents are incorporated herein by reference.

DESCRIPTION OF REFERENCE NUMERALS AND SIGNS

1 Refining furnace
2 Molten metal
3*a*, 3*b* Gas supply line
4 Pipe joint
5 Gas piping
7 Amorphous refractory
10 First nozzle section
11*a* Furnace-side tips of first narrow metal pipes
11 First narrow metal pipes
12 First surge tank
13 First refractory
13*a* Surface of first refractory
20 Second nozzle section
21*a* Furnace-side tips of second narrow metal pipes
21 Second narrow metal pipes
22 Second surge tank
23 Second refractory
23*a* Surface of second refractory
31 Support refractory
31*a* Refractory member having a rectangular planar shape
41 A plurality of narrow metal pipes constituting gas blowing nozzle B for comparison
42 Surge tank constituting gas blowing nozzle B for comparison
43 Refractory constituting gas blowing nozzle B for comparison
51 A plurality of narrow metal pipes constituting gas blowing nozzle of embodiment 2
52 Surge tank constituting gas blowing nozzle of embodiment 2
53 Refractory constituting gas blowing nozzle of embodiment 2
51*a* Furnace-side tips of narrow metal pipes constituting gas blowing nozzle of embodiment 2
61 Narrow metal pipes constituting gas blowing nozzle C
62 Surge tank constituting gas blowing nozzle C
63 Refractory constituting gas blowing nozzle C
A Gas blowing nozzle
A1 Gas blowing nozzle of embodiment 2
B Gas blowing nozzle for comparison
C Gas blowing nozzle corresponding to first nozzle section
G Interval between first narrow metal pipes and second narrow metal pipes
D Distance (embedded depth) of from surface of second refractory to furnace-side tips
L Entire length of first and second refractories
M Erosion difference of refractory by position

The invention claimed is:

1. A gas blowing nozzle for blowing a gas to a molten metal in a furnace, comprising a plurality of narrow metal pipes for gas introduction, a surge tank storing a gas before blowing, and a refractory protecting the narrow metal pipes and the surge tank, the gas blowing nozzle comprising:

a first nozzle section comprising a plurality of first narrow metal pipes having open furnace-side tips exposed to an inside of the furnace and being in the state capable of blowing a gas to the molten metal in the furnace, a first surge tank communicated with the first narrow metal pipes, and a first refractory protecting the first narrow metal pipes and the first surge tank; and a second nozzle section comprising a plurality of second narrow metal pipes, a second surge tank communicated with the second narrow metal pipes, and a second refractory protecting the second narrow metal pipes and the second surge tank, wherein furnace-side tips of the second narrow metal pipes are embedded in the second refractory such that the furnace-side tips of the second narrow metal pipes are located in a given depth and the furnace-side tips are occluded, wherein a passageway from the second surge tank to the furnace-side tips of the second narrow metal pipes is open such that while applying pressure of the gas to the second nozzle section, and when erosion of the second refractory reaches the furnace-side tips of the second narrow metal pipes embedded in the second refractory, the occluded furnace-side tips of the second narrow metal pipes are opened, and blowing of a gas from the second narrow metal pipes begins.

2. The gas blowing nozzle according to claim 1, wherein the first narrow metal pipes and the second narrow pipes are arranged at intervals of from 100 to 1,000 mm in the closest portion.

3. The gas blowing nozzle according to claim 1, wherein the second narrow metal pipes are embedded in a depth such that a distance from a surface of the second refractory to the furnace-side tips is 14% or more of a nozzle effective length.

* * * * *